US007669278B2

(12) United States Patent
Arikita

(10) Patent No.: US 7,669,278 B2
(45) Date of Patent: Mar. 2, 2010

(54) STRUCTURE OF BRUSH MOUNT FOR CUTTING TABLE

(75) Inventor: Reiji Arikita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 979 days.

(21) Appl. No.: 10/520,263

(22) PCT Filed: Jul. 7, 2003

(86) PCT No.: PCT/JP03/08643

§ 371 (c)(1),
(2), (4) Date: Jan. 6, 2005

(87) PCT Pub. No.: WO2004/007830

PCT Pub. Date: Jan. 22, 2004

(65) Prior Publication Data

US 2006/0053991 A1 Mar. 16, 2006

(30) Foreign Application Priority Data

Jul. 11, 2002 (JP) ..... 2002-202224

(51) Int. Cl.
*A47L 9/00* (2006.01)

(52) U.S. Cl. ..... 15/308; 269/21

(58) Field of Classification Search ..... 15/308, 15/309, 310; 269/21, 311; 83/451, 658
See application file for complete search history.

(56) References Cited

U.S. PATENT DOCUMENTS 5,189,936 A 3/1993 Gerber et al.
5,282,407 A * 2/1994 Arikita ..... 83/422
5,358,226 A * 10/1994 Arikita ..... 269/21
2006/0053991 A1* 3/2006 Arikita ..... 83/168
2007/0169597 A1* 7/2007 Morita ..... 83/13

FOREIGN PATENT DOCUMENTS

JP 3-26496 A 2/2005

* cited by examiner

*Primary Examiner*—Lee D Wilson
(74) *Attorney, Agent, or Firm*—Rothwell, Figg, Ernst & Manbeck, PC

(57) ABSTRACT

The invention provides a brush mounting structure of an automatic cutting machine that can allow dismount of any desired brush from a brush mount, can allow sequential rotation of the movable brushes so that the brushes on the brush mounts can be rearranged in parallel, and can allow a clamping force for clamping engagement between the brush and the brush mount to be held against a load applied from a particular direction. In order to prevent undesired disengagement of the projection at the back side of the cut-support-surface brush against a load applied from a particular direction orthogonal to a direction in which the brush is movable over the brush mount, an engaging projection having an engaging surface which is adapted to be hooked more firmly than an engaging surface of a back-row projection and serves as a holding surface is formed in a front low of the brush, while also a holding rib having a holding surface which confronts the engaging surface of the engaging projection of the brush and is adapted to be hooked more firmly than the engaging surface of the engaging rib is formed in the brush mount.

11 Claims, 3 Drawing Sheets

STRUCTURE OF BRUSH MOUNT FOR CUTTING TABLE

CROSS REFERENCE TO RELATED APPLICATION

This application is a 35 USC § 371 National Phase Entry Application from PCT/2003/008643, filed Jul. 7, 2003, and designating the U.S.

TECHNICAL FIELD

The present invention relates to an improvement of a brush mounting structure for a cut-support surface of a cutting table of an automatic cutting machine for cutting a sheet material, such as a knitted fabric and a woven fabric, to a desired form.

BACKGROUND ART

The automatic cutting machine is structured so that a sheet material spread on the cutting table can be carried in and cut to a desired form with a cutter knife adapted to be movable while moving up and down from above. When cutting, the cutter knife is freely moved back and forth and around in the state of its cutter blade being stabbed into the cutting table and, accordingly, the cutting table is formed by and paved with hard brush hairs, to allow such a free movement of the cutting knife. Further, the cutting table serves as a conveyer movable to carry out the sheet material after cut. For example, in the arrangement of a brush mount and a cut-support surface brush proposed by JP Laid-open (Unexamined) Patent Publication No. Hei 3-26496, each brush is adapted to be movable by the fit in longitudinally extending slots in the brush mount. In this arrangement, when the brush is mounted to and dismounted from the brush mount for replacement purpose, the each brush is moved and attached to and/or detached from an end of the brush mount.

This arrangement of the brush mount and the cut-support surface brush can allow the brush to move on the brush mount along the slots, but cannot allow the attachment/detachment of the brush from its own place. For example, when a brush have to be replaced, for example, for the reason that cut-support surface brush hairs located around a center of the cut-support surface formed by a number of cut-support brush hairs is damaged, the brush including the non-damaged brush hairs as well as the damaged brush hairs must be moved and removed from the brush mount for a while and then the block of brush hairs including the new brush hairs must be returned to the related brush mount. Thus, the arrangement above requires a time-consuming and troublesome work for the replacement. In order to save this trouble, the applicant of this application previously proposed, for example, in JP Laid-open (Unexamined) Patent Publication No. Hei 5-71067, an automatic cutting machine having a brush mounting structure for the cut-support surface that can allow the damaged brush to be removed from above the cut-support surface, for replacement with the new one.

However, in the structure that can allow removal of any desired brush by lifting it from above the cut-support surface, a clamping engagement between the brush and the brush mount is allowed by only a claming force of the order that can permit the brush to be lifted up by hand. Due to this, when a load more than an allowable load is applied to the brush or when a load is continuously applied to the brush from a particular direction, the claming force is weakened so that the brush may be disengaged from the brush mount. For instance, a comb-like member to scoop out the sheet material is fixed at an end of the cutting table in such a manner as to hide among the hard brush hairs so that when the sheet material, after cut, is carried to a carry-out portion of the cut-support surface by the cut-support surface serving as the conveyer, the sheet material can be released from the cut-support surface by the comb-like member. With this arrangement, when the hard brush hairs are intertwisted and thereby arranged nonuniformly during the uninterrupted operation, a load more than the allowable load is applied to the brush from a front side with respect to a traveling direction of the conveyer or a continuous load is repeatedly applied to the brush in the long run. As a result of this, the claming force for clamping engagement between the brush and the brush mount is weakened earlier, producing the problem of increasing the likelihood that the brush may be disengaged from the brush mount.

DISCLOSURE OF THE INVENTION

In the light of the problem mentioned above, the present invention has been made. It is the object of the present invention to provide a brush mounting structure of a cut-support surface of an automatic cutting machine that can allow selective dismount of any desired brush, out of a number of cut-support surface brushes on their respective brush mounts for the cut-support surfaces arranged in parallel, from the related brush mount, can allow sequential rotation of the movable brushes so that the brushes on the brush mounts can be rearranged in parallel, and can allow a clamping force for clamping engagement between the brush and the brush mount to be held against a load applied to the brush from a particular direction.

The present invention provides a brush mounting structure of a cutting table in an automatic cutting machine comprising a cut-support surface for a sheet material formed by a number of brush hairs arranged on a brush mount for the cut-support surface, a suction mechanism, disposed under the brush mount, for suctioning the sheet material put on the cut-support surface, and a cutting device disposed over the cut-support surface and adapted to be movable to any selected position so that the sheet material on the cut-support surface can be cut to a desired shape by movement of the cutter device, the cut-support surface for the sheet material being adapted to be movable as a conveyor to carry out the sheet material after cut, wherein the cut-support surface brush has a number of hard hairs at a front side of a base thereof having air suction holes and has a plurality of rows of projections at a back side of the same, the projections of the brush being detachably engageable with and movable with respect to the brush mount, wherein an engaging projection having an engaging surface which is adapted to be hooked more firmly than an engaging surface of a back-row projection and serves as a holding surface is formed in a front low of the brush, to prevent undesired release of the engagement between the brush and the brush mount against a load applied from a particular direction orthogonal to a direction in which the brush is movable over the brush mount, and wherein an engaging rib having an engaging surface confronting the engaging surface of the projection of the brush, and a holding rib having a holding surface which confronts the engaging surface of the engaging projection of the brush and is adapted to be hooked more firmly than the engaging surface of the engaging rib are formed in the brush mount.

It is structurally preferable that an auxiliary rib via which a back side of the engaging projection formed in the cut-support-surface brush is guided is formed in the brush mount at a location behind the holding rib, so that a load applied from the front side of the brush is born on the auxiliary rib.

It is also preferable that an auxiliary projection is formed in the cut-support-surface brush at a location behind the engaging projection, so that a load applied from the front side of the brush is born on the auxiliary projection, while also an auxiliary rib via which a back side of the auxiliary projection is guided is formed in the brush mount.

With the construction above, a number of brushes can be movably mounted on the respective brush mounts for the cut-support-surface brushes, putting the engaging projections of the cut-support surface brushes in engagement with the holding ribs of the brush mount for the cut-support surface brushes. The cut-support surface is formed by a number of brush hairs of the brush mounted on the brush mount.

When a brush hair(s) of the brush is/are damaged due to the cutting operation and is replaced with the new one, the damaged brush is lifted up at one end thereof where the holding projection is not provided, to release the clamping engagement, so as to remove the damaged brush from the brush mount at that location. Then, when a new brush is reset, the engaging projection of the brush is engaged with the holding rib of the brush mount located at the same location or at a different location at which room is made for the new brush by moving the remaining brushes. Thereafter, the projection formed at the other end of the brush is put into clamping engagement with the engaging rib of the brush mount. In addition to this, even when the brush is lifted up at a portion thereof where the engaging projection of the brush is in engagement with the holding rib of the brush mount, the engaging projection of the brush and the engaging rib of the brush mount are engaged with each other so firmly that they cannot be disengaged easily. Further, the brush mounting structure of the invention is structured to bear the load applied to each individual brush, so that when the cut-support surface formed by a number of brush hairs serves as the conveyer and carries the sheet material toward the sheet-material-carry-out portion, the projections formed in the brush are prevented from being resiliently bent by the pushing force applied to the brush from the front side thereof.

BRIEF DESCRIPTION OF THE DRAWINGS

The objects, features and advantages of the present invention will become more apparent by referring to the following detailed description and appended drawings in which.

BEST MODE FOR CARRYING OUT THE INVENTION

Figure 1:
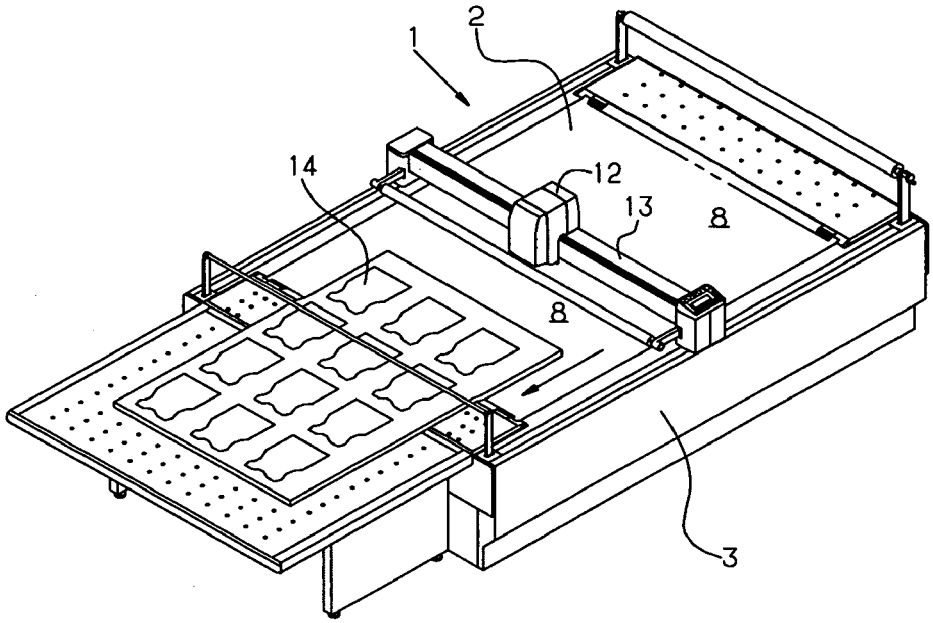
FIG. 1 shows a perspective view of an automatic cutting machine according to the present invention.
Figure 2:
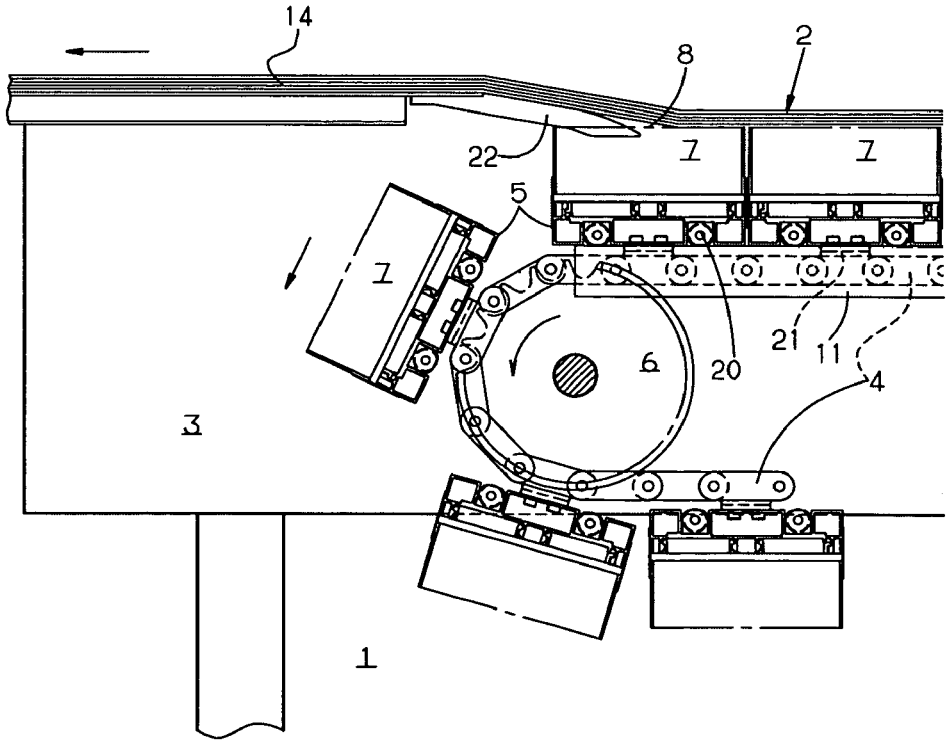
FIG. 2 shows a side view of a principal part of the arrangement wherein the brush mount for cut-support surface and the cut-support-surface brush are arranged to the automatic cutting machine.
Figure 3:
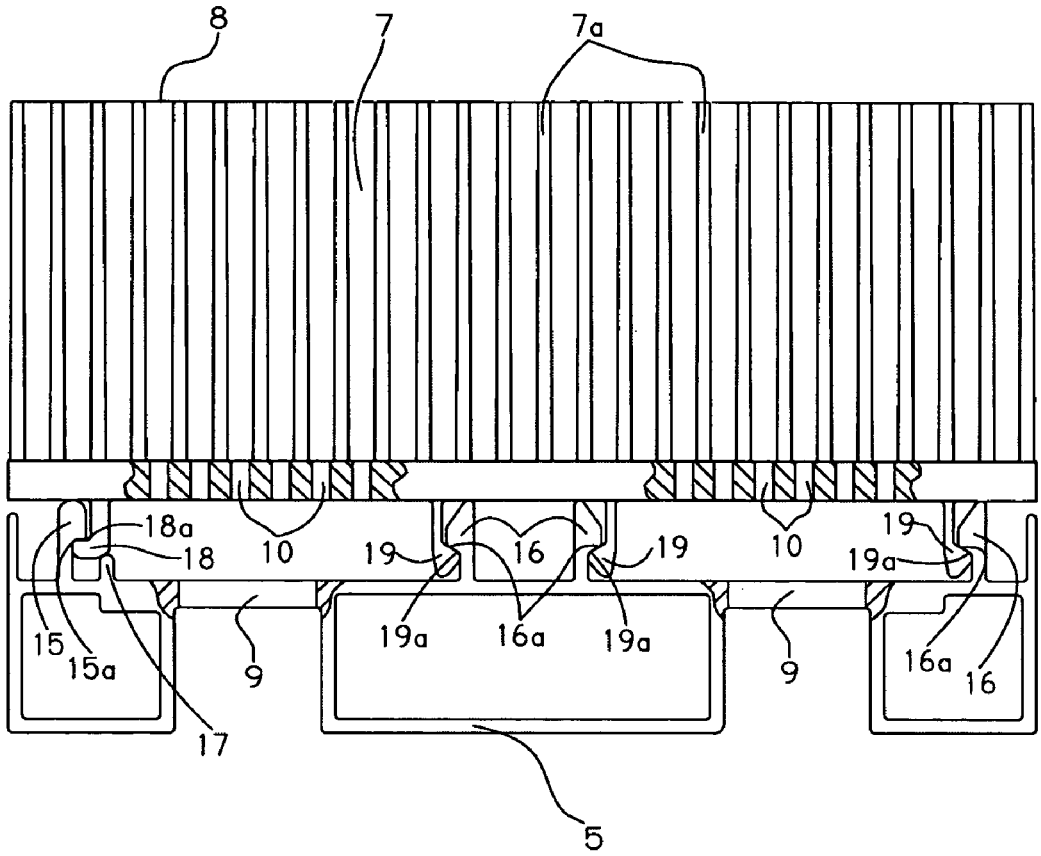
FIG. 3 shows a partly cutout side view showing engagement between the brush mount for cut-support surface and the cut-support-surface brush of an embodiment according to the present invention.
Figure 4:
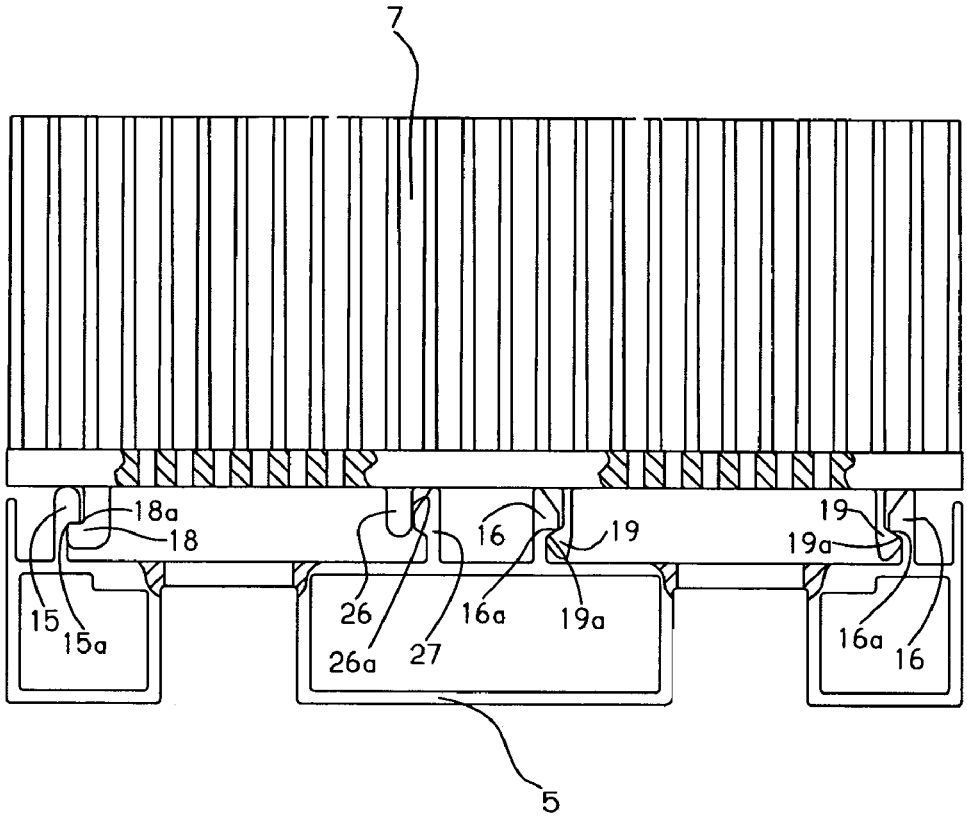
FIG. 4 shows a partly cutout side view showing engagement between the brush mount for cut-support surface and the cut-support-surface brush of another embodiment according to the present invention.
Figure 5:
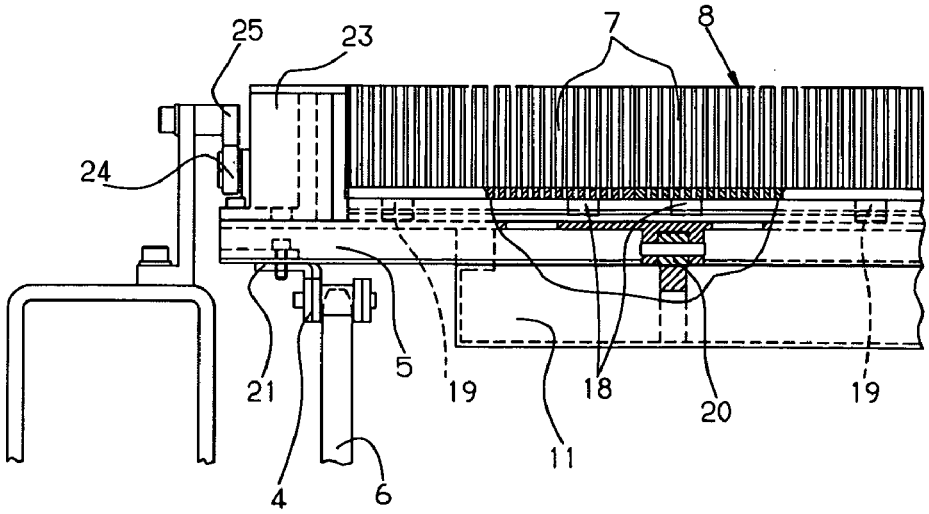
FIG. 5 shows a front view of a principal part of the arrangement wherein the brush mount for cut-support surface and the cut-support-surface brush are arranged to the automatic cutting machine.

In the following, certain embodiments of the present invention will be described as preferred embodiments of the invention with reference to FIGS. 1-5. FIG. 1 illustrates the entire arrangement of the automatic cutting machine, and FIG. 2 illustrates a partial sectional view of a sheet-material-carry-out portion of a cutting table of the automatic cutting machine. Arrows in the drawing indicate directions in which the sheet material and the brushes are traveled when the sheet material is carried. FIGS. 3 and 4 show in enlargement the state of the brush in the form of a sheet material carrying surface of the cutting table being engaged with the brush mount. FIG. 5 shows a partial sectional view of the arrangement wherein the brushes are arranged in parallel on the brush mounts.

A cutting table 2 of an automatic cutting machine 1 has endless chains 4 arranged at both lateral sides of an automatic cutting machine body 3, and a number of brush mounts for cut-support-surface brush (hereinafter they are simply called "brush mount") 5 arranged in line on and bridged between the endless chains 4. The respective brush mounts 5 are traveled by rotation of the endless chains 4 driven by a drive unit 6. Each of the brush mounts 5 is provided with a block of brush hair for cut-support surface (hereinafter they are simply called "brush") 7. Hard hairs 7*a* of the each brush 7 form a cut-support surface 8 on which a sheet material to be cut 14 is spread.

Further, the brush mount 5 and the brush 7 have air holes 9, 10 at bases thereof, respectively, and a suction unit 11 to suck in the sheet material 14 put on the cut-support surface 8 of the cutting table 2 is provided under the brush mount 5 so that the sheet material 14 on the cut-support surface 8 of the cutting table 2 can be held by suction generated by the operation of the suction unit 11.

A cutter 12 designed to be movable transversely is supported on a supporting bridge 13 designed to be movable longitudinally and is disposed over the cutting table 2. The cutter 12 is driven to move along the supporting bridge 13 in the transverse direction by a drive unit (not shown), and the supporting bridge 13 is also driven to move along the cutting table 2 in the longitudinal direction by the drive unit (not shown). The cutter 12 is provided with a cutter knife adjustable in vertical movement and orientation of the cutter blade. The transverse movement of the cutter 12 and the longitudinal movement of the supporting bridge 13 can allow the cutter 12 to move to any selected position in the cutting table 2, and as such can allow the cutter 12 to cut the sheet material 14 on the cut-support surface 8 to any desired form. The terms, "transverse direction" and "longitudinal direction" are defined here as follows. The longitudinal direction is defined as a direction in which the cut-support surface 8 of the cutting table 2 is rotationally traveled forward (a direction indicated by an arrow) or backward (opposite thereto), when views from above. The transverse direction is defined as a direction orthogonal to the longitudinal direction.

Now, the arrangement of the brush mount 5 and the brush 7 in the automatic cutting machine 1 is described further on the brush mounting structure of the cutting table of the present invention. The brush mount 5 is a rigid section having an adequate length for opposite ends thereof to bridge between the endless chains 4 arranged at the both lateral sides of the automatic cutting machine body 2 and has a number of properly spaced apart air holes 9. The brush mount 5 has at an upper portion thereof the structure that can allow a number of brush hairs 7 to be held in rows in the longitudinal direction. As shown in FIG. 3, the upper portion of the brush mount 5 has a single line of holding rib 15 and a multiple rows of engaging ribs 16 which are formed to project upwards and spaced apart in the longitudinal direction. The holding rib 15 is formed in the front row with respect to the direction of the brush mount being traveled via the endless chains 4 and has a surface overhanging rearwards at a head portion thereof. The overhanging surface of the holding rib 15 is formed as a holding surface 15*a* extended substantially in parallel with the cut-support surface 8, or inclined or curved, upwards or downwards, with respect to the cut-support surface 8. Engaging ribs 16 are formed at locations behind the holding rib 15, each having a surface overhanging laterally at a head portion thereof. The overhanging surface of the engaging rib 16 is formed as a smooth, obliquely extended, engaging surface 16*a*. Further, an auxiliary rib 17 is preferably formed at a rear side of the holding rib 15 to guide a back surface of an engaging projection 18 of the brush 7, as mentioned later. The brush mount 5 has, at each side of a lower portion thereof, auxiliary rollers 20. The auxiliary rollers 20 are disposed at locations close to both ends or at proper locations so that the brush mount 5 can be fixed to attachments 21 attached to spaced apart links of the endless chains 4 at both ends of a center portion of the brush mount 5. The respective brush mounts 5 are bridged between the endless chains 4 and arranged in line thereon.

On the other hand, the brush 7 mounted on the brush mount 5 is formed of material having flexibility, such as synthetic resin, and has a number of air holes 10. The brush 7 has, at an upper portion thereof, a number of hard hairs 7*a* and has, at a lower portion thereof, engaging projection 18*a* confronting the holding surface 15*a* of the holding rib 15 of the brush mount 5 and adapted to be detachably engageable with the holding rib 15, and clamping projections 19 confronting the engaging surfaces 16*a* of the multiple rows of engaging ribs 16 provided on the brush mount 5. The engaging projection 18 has a forwardly overhanging surface at a head portion thereof. The overhanging surface of the engaging projection 18 is formed as a holding surface 18*a* extended substantially in parallel with the cut-support surface 8, or inclined or curved, upwards or downwards, with respect to the cut-support surface 8. The engaging projection 18 is formed to have an adequate thickness for rigidity. It is structurally preferable and further effective that the engaging projection 18 is designed so that its back surface can be guided by the auxiliary rib 17 provided in the brush mount 5. The auxiliary rib 17 serves to bear a load applied to the brush 7 from a front side thereof. The clamping projections 19 have smooth, inclined, engaging surfaces 19*a* formed to engage with the engaging surface 16*a* of the engaging ribs 16 and are formed to have adequate thickness for adequate resilience. The holding surface 15*a* of the holding rib 15 of the brush mount 5 and the holding surface 18*a* of the engaging projection 18 of the brush 7 are put in engagement with each other, thereby producing a hooking effect and also producing a force to moderately press the engaging surface 16*a* of the engaging rib 16 of the brush mount 5 and the inclined engaging surfaces 19*a* of the clamping projections 19 of the brush 7 to allow movement of the brush 7 on the brush mount 5.

Thus, when a rear portion of the brush 7 is lifted up, the clamping projections 19 having resilience are resiliently bent along the engaging surfaces 16*a* of the engaging ribs 16 of the brush mount 5 and removed from the engaging surfaces 16*a*, first. Then, the engaging projection 18 of the brush 7 is slipped out and disengaged from the holding surface 15*a* of the holding rib 15 of the brush mount 5. As a result, the engagement of the brush 7 with the brush mount 5 is released. However, even when the brush 7 is lifted up at one end thereof on the engaging projection 18 side, since the holding surface 18*a* of the engaging projection 18 and the holding surface 15*a* of the holding rib 15 formed in the front row of the brush mount 5 are extended substantially in parallel with the cut-support surface 8, or inclined or curved, upwards or downwards, with respect to the cut-support surface 8 and are firmly engaged with each other in a hooked manner, the engagement therebetween is not released easily. The brush 7 is mounted on the brush mount 5 in the following sequences. First, the engaging projection 18 is inserted in under the holding rib 15, so that the holding surface 18*a* of the engaging projection 18 is engaged with the holding surface 15*a* of the holding rib 15 of the brush mount 5. Then, the clamping projections 19 of the brush 7 are thrust down from above the engaging ribs 16 of the brush mount 5, so that the resilient clamping projections 19 of the brush 7 are resiliently bent along the engaging ribs 16 of the brush mount 5 and are fitted into indents under the engaging ribs 16. Then, the inclined engaging surfaces 19*a* of the clamping projections 19 of the brush 7 and the engaging surfaces 16*a* of the engaging ribs 16 of the brush mount 5 are brought into engagement with each other.

The above-said construction of the brush mount 5 and the brush 7 can allow the block of brush hairs 7 to be arranged on the brush mount 5 by putting the holding rib 15 arranged in the front row and the engaging ribs 16 arranged in the other rows of the brush mount 5 into engagement with the engaging projection 18 and the clamping projections 19 of the each brush 7, respectively. Guide blocks 23 are fixed to both ends of the brush 7 on the brush mount 5 to close the lateral sides of the brush 7, and guide rollers 24 are provided to guide the brush 7 through guide bars 25. After these processes, the cutting table having the cut-support surfaces which are formed by a number of brushes 7 on a number of brush mounts 5 arranged in line on and bridged between the endless chains 4 is formed.

When a brush hair(s) 7*a* of the brush 7 is/are damaged due to the cutting operation, the damaged brush 7 is lifted up at one end thereof on the rear side so that the engagement between the brush and the brush mount can be released, thereby removing the damaged brush 7 from the brush mount 5. A new brush 7 may be set in the brush mount 5 at a different location, moving the remaining brushes 7 to close up the missing space, or may alternatively be reset in the related brush mount 5 at the original location.

The sheet material 14 after cut is carried toward the carry-out portion of the cut-support surface 8 over the cutting table 2, while moving together with the cut-support surface 8, and then is scooped out at the end of the cutting table 2 by a comb-like member 22 and released from the cut-support surface 8 by the comb-like member 22. The comb-like member 22 is hidden among the hard brush hairs 7*a* of the brush 7 forming the cut-support surface 8, in order to surely release the sheet material 14 from the cut-support surface 8 by the comb-like member 22. With this arrangement, when the cut-support surface 8 is moved to carry the sheet material 14 after cut, a load is applied to the brush 7 from the front side by the comb-like member 22 and an additional load to lift up the brush 7 is applied thereto at a location where the hard brush hairs 7*a* are intertwisted. To prevent release of the brush 7 from the brush mount 5 against the load applied by the comb-like member 22, the brush mount 5 is provided, in the front row, with the holding rib 15, while also the brush 7 is provided, in the front row, with the engaging projection 18 confronting the holding rib 15, so that their respective holding surfaces 15*a*, 18*a* are engaged with each other. Differently from the smooth engaging surfaces 16*a*, 19*a* located behind the holding surfaces 15*a*, 18*a*, these holding surfaces 15*a*, 18*a* are configured to be firmly hooked each other, so as to prevent the brush 7 from being slipped off upwardly easily even when a load to try to lift up a front portion of the brush 7 is applied to the brush 7. The overhanging bosses of the holding rib 15 and engaging projection 18 may be configured in a wedge form so that the holding surfaces 15*a*, 18*a* can be engaged with each other further effectively. This configuration can allow the load applied to the brush from the front side to be born on the holding surfaces. In addition, projection and depression may be formed on the holding surfaces 15*a*, 18*a* of the overhanging bosses of the holding rib 15 and engaging projection 18 to provide a firm engagement therebetween.

It is further preferable that the auxiliary rib 17 for bearing the load applied from the front side of the brush is formed on the brush mount 5 at the rear side of the front end portion of the holding projection 18. This structure can produce a good effect for mounting the brush. Also, a variant to bear the load applied from the front side of the brush may be adopted. Specifically, the brush 7 is provided, in a location behind the engaging projection 18, with an auxiliary projection 26 having an adequate thickness for rigidity, while also the brush mount 5 is provided with an auxiliary rib 27 to guide a rearwardly facing wall 26*a* of the auxiliary projection 26, as shown in FIG. 4. This construction can also provide a good effect for mounting the brush.

As an alternative to the illustrated embodiment wherein the holding rib 15 of the brush mount 5 is protruded rearwardly and the engaging projection 18 of the brush 7 is protruded forwardly so that the respective holding surfaces 15*a*, 18*a* can be engaged with each other, the holding rib 15 may be protruded forwardly and the engaging projection 18 may be protruded rearwardly so that the respective holding surfaces 15*a*, 18*a* can be engaged with each other.

Also, as an alternative to the illustrated embodiment which is structured so that the load applied to the brush 7 from the front side thereof can be born directly on the auxiliary rib 17 of the brush mount 5 for guiding the engaging projection 18 of the brush 7 or on the auxiliary rib 27 of the brush mount 5 for guiding the auxiliary projection 26, a wire may be inserted in between the auxiliary rib 17 and the back side of the holding projection 18 or between the auxiliary rib 27 and the auxiliary projection 26. The alternative can produce substantially the same result.

Also, it is needless to say that as an alternative to the embodiment illustrated in FIG. 4 wherein the auxiliary rib 27 is formed on the brush mount 5 at a directly rear side of the holding rib 15 and the auxiliary projection 26 is formed on the brush 7 at a directly rear side of the engaging projection 18, the auxiliary rib 27 may be formed at the end of the row of the brush mount 5 and the auxiliary projection 26 may be formed at the end of the row of the brush 7. Further, a variant that instead of the auxiliary projection 26 of the brush 7, a recessed groove may be formed in the base of the brush 7 and also a rearwardly facing surface of the recessed groove may be guided by the auxiliary rib 27 of the brush mount may be adopted. This variant can also produce substantially the same result.

The present invention may be practiced in several forms without departing from the spirit or essential characteristic thereof. Accordingly, the foregoing embodiments are only illustrative in every aspect and not restrictive, so that the scope of the invention is defined by the appended claims rather than by the description. Further, all modifications and changes that fall within meets and bounds of the claims are within the scope of the invention.

CAPABILITIES OF EXPLOITATION IN INDUSTRY

As evident from the foregoing, the brush mounting structure of the cutting table of the automatic cutting machine of the invention can maintain easiness in engagement and disengagement between the brush and the brush mount, can prevent unwanted detachment of the brush from the brush mount against a load applied from the front side to the brush when moving as the conveyer, and can suppress reduction of the clamping force to clamp the brush and the brush mount even when an uninterrupted load is repeatedly applied to the brush during a long period, thereby producing improved durability of the brush.

The invention claimed is:

1. A brush mounting structure for a cutting table in an automatic cutting machine, the brush mounting structure comprising at least one cut-support surface brush mounted onto a brush mount, the brush hairs of the cut-support surface brush forming a cutting surface for a sheet material, the cutting machine having a suction mechanism, disposed under the brush mount, for suctioning the sheet material put on the cut-support surface, and a cutting device disposed over the cut-support surface and adapted to be movable to any selected position so that the sheet material on the cut-support surface can be cut to a desired shape by movement of the cutter device, the cut-support surface for the sheet material being adapted to be movable as a conveyor to carry out the sheet material after cut;

wherein the cut-support surface brush has a number of hard hairs at an upper side of a base thereof having air suction holes and has a plurality of rows of projections at a reverse side of the same, the projections of the brush being detachably engageable with and movable with respect to the brush mount, wherein the brush and brush mount are arranged to travel along an endless chain of the cutting table, in use, and have a front end and a rear end relative to the direction of travel, and wherein the brush is movable with respect to the brush mount in a side to side direction relative to the direction of travel;

wherein the projections include an engaging projection having an engaging surface formed in a front row of projections of the brush which is configured differently than an engaging surface of a back row of projections and which is adapted to be hooked more firmly than the engaging surface of the back-row projection and which serves as a holding surface to prevent undesired release of the engagement between the brush and the brush mount against a load applied from a direction normal to the cut support surface, and wherein the mount includes an engaging rib having an engaging surface confronting the engaging surface of the back row of projection of the brush, and a holding rib having a holding surface which confronts the engaging surface of the front row of engaging projection of the brush and wherein the holding rib is configured differently than the engaging rib and is adapted to be hooked more firmly than the engaging surface of the engaging rib;

such that when a rear portion of the brush is lifted, the back row projection releases from the engaging rib enabling disengagement of the brush from the mount, but when the brush is lifted at a front end thereof, it is hooked more firmly and not so easily disengaged as when lifted at the rear portion.

2. The brush mounting structure according to claim 1, wherein an auxiliary rib via which a back side of the engaging projection formed in the cut-support-surface brush is guided is formed in the brush mount at a location behind the holding rib, so that a load applied from the front side of the brush is born on the auxiliary rib.

3. The brush mounting structure according to claim 1, wherein an auxiliary projection is formed in the cut-support-surface brush at a location behind the engaging projection, so that a load applied from the front side of the brush is born on the auxiliary projection, while also an auxiliary rib via which a back side of the auxiliary projection is guided is formed in the brush mount.

4. The brush mounting structure of claim 1, wherein said engaging surface of said front row of projections and said holding surface of said holding rib have cooperating L-shapes, and said engaging surface of said back row of projections and said engaging surface of said engaging rib have cooperating oblique shapes.

5. The brush mounting structure of claim 1, further comprising:

one or more intermediate rows of engaging projections extending from the brush between the front row of projections and the back row of projections; and one or more engaging ribs having engaging surfaces extending from the brush mount and configured to be engageable with said one or more intermediate rows of engaging projections, wherein said engaging surface of said intermediate row of projections and said engaging surface of said engaging rib engageable with said intermediate row of engaging projections have cooperating oblique shapes.

6. The brush mounting structure of claim 1, wherein said back row of projections and said engaging rib are more resilient than said front row of projections and said holding rib.

7. A brush mounting structure for an automatic cutting machine including a cutting surface defined by at least one brush mounted on a brush mount, wherein the brush and the brush mount are carried on an endless chain and the brush has a front portion and a rear portion relative to the direction of travel, the brush mounting structure comprising:

a front row of engaging projections formed adjacent the front portion of the brush and extending from a reverse side of the brush opposite the side that defines the cutting surface;

a rear row of clamping projections formed adjacent the rear portion of the brush and extending from the reverse side of the brush;

a holding rib extending from the brush mount and engageable with the front row of engaging projections; and an engaging rib extending from the brush mount and engageable with the rear row of engaging projections, wherein the engaging projections of the front row are configured differently than the clamping projections of the rear row and the holding rib is configured differently than the engaging rib such that engagement of the front row of engaging projections with the holding rib provides a stronger resistance against a separating force applied transversely to the cutting surface at the front portion of the brush than engagement of the rear row of clamping projections with the engaging rib provides against a separating force applied transversely to the cutting surface at the rear portion of the brush.

8. The brush mounting structure of claim 7, wherein said front row of engaging projections and said holding rib have cooperating L-shapes, and said rear row of clamping projections and said engaging rib have cooperating oblique shapes.

9. The brush mounting structure of claim 7, further comprising:

one or more intermediate rows of clamping projections extending from the reverse side of the brush between the front row of engaging projections and the rear row of clamping projections; and one or more engaging ribs extending from the brush mount and configured to be engageable with said one or more intermediate rows of clamping projections, wherein said intermediate row of clamping projections and said engaging ribs engageable with said intermediate row of clamping projections have cooperating oblique shapes.

10. The brush mounting structure of claim 7, wherein said holding rib includes a holding surface that is substantially parallel to the direction of travel, said engaging projection include a holding surface configured to confront the holding surface of the holding rib, said engaging rib includes smooth obliquely extended engaging surface, and said clamping projections include a smooth, inclined engaging surface configured to engage the engaging surface of a corresponding engaging rib.

11. The brush mounting structure of claim 7, wherein said rear row of clamping projections and said engaging rib are more resilient than said front row of engaging projections and said holding rib.

* * * * *